US007762268B2

(12) United States Patent
Baxter

(10) Patent No.: US 7,762,268 B2
(45) Date of Patent: Jul. 27, 2010

(54) NAIL POLISHING TOOL AND METHOD

(76) Inventor: April Lynne Baxter, 15B Ullemay Ct., Palm Coast, FL (US) 32164

( * ) Notice: Subject to any disclaimer, the term of this patent is extended or adjusted under 35 U.S.C. 154(b) by 324 days.

(21) Appl. No.: 11/722,382

(22) PCT Filed: Dec. 7, 2005

(86) PCT No.: PCT/US2005/044579

§ 371 (c)(1),
(2), (4) Date: Jun. 21, 2007

(87) PCT Pub. No.: WO2006/068857

PCT Pub. Date: Jun. 29, 2006

(65) Prior Publication Data

US 2008/0092914 A1 Apr. 24, 2008

Related U.S. Application Data

(60) Provisional application No. 60/649,680, filed on Feb. 3, 2005, provisional application No. 60/637,911, filed on Dec. 21, 2004.

(51) Int. Cl.
*A45D 29/00* (2006.01)
*A45D 7/00* (2006.01)

(52) U.S. Cl. ..... 132/200; 132/73

(58) Field of Classification Search ..... 132/73, 132/285, 319, 75.3, 73.5, 200; 401/35, 34, 401/17, 16

See application file for complete search history.

(56) References Cited

U.S. PATENT DOCUMENTS

| | | | | | |
|---|---|---|---|---|---|
| 1,289,952 | A | | 12/1918 | Struble | |
| 1,715,914 | A | * | 6/1929 | Halk | 132/73 |
| 1,935,901 | A | * | 11/1933 | Augenblick | 8/523 |
| 1,990,630 | A | * | 2/1935 | Bensel | 434/100 |
| 2,055,357 | A | | 9/1936 | Konecke | |
| D116,066 | S | * | 8/1939 | Twomey | D9/436 |
| 2,279,520 | A | | 4/1942 | Perillo | |
| 2,467,570 | A | | 4/1949 | Ward | |
| 2,566,852 | A | | 9/1951 | Platt | |
| 3,097,386 | A | | 7/1963 | Marani | |
| D252,890 | S | | 9/1979 | Cavalieri | |
| D283,738 | S | | 5/1986 | Kilman et al. | |
| D291,930 | S | | 9/1987 | Kilman et al. | |
| 5,778,903 | A | | 7/1998 | Tran et al. | |
| 5,890,499 | A | | 4/1999 | Fuentes et al. | |
| 5,937,873 | A | * | 8/1999 | Schlosser et al. | 132/320 |
| 6,120,202 | A | * | 9/2000 | Donsky | 401/35 |
| 6,305,389 | B1 | | 10/2001 | Bakken | |
| 6,675,813 | B2 | | 1/2004 | Chu | |
| 2003/0089378 | A1 | * | 5/2003 | Chu | 132/200 |
| 2005/0072355 | A1 | * | 4/2005 | Petit | 118/255 |

* cited by examiner

*Primary Examiner*—Robyn Doan
(74) *Attorney, Agent, or Firm*—Hovey Williams LLP

(57) ABSTRACT

The invention provides a manicure tool and method, specifically designed for the application of fingernail polish to the nail beds of human fingernails. The invention is described as a nail polish applicator with a central hub and four different sized, slightly concave protrusions on which the end of each has inverted crescent shaped ends.

7 Claims, 2 Drawing Sheets

NAIL POLISHING TOOL AND METHOD

CROSS-REFERENCE TO RELATED APPLICATIONS

The present application claims the benefit of International Application No. PCT/US2005/044579, filed Dec. 7, 2005, which claims the benefit of U.S. Provisional Application No. 60/637,911, entitled FRENCH TIP DIP, filed Dec. 21, 2004, and U.S. Provisional Application No. 60/649,680, entitled FRENCH TIP DIP, filed Feb. 3, 2005, both all of which are incorporated by reference herein.

BACKGROUND OF THE INVENTION

1. Technical Field

This invention relates to a manicuring or nail polishing method and device. It is described as a new and useful method and device used in the application of liquid nail polish to the tips of human fingernails and toenails.

2. Description of Related Art

French manicures and pedicures are one of the most popular nail designs for special occasions and daily wear (FIG. 3). The design consists of a white fingernail polish (12) applied in a crescent shape at the tip of the fingernail (14) or toenail, then overlaid with a coat of pink, (16) clear, or any number of transparent fingernail polishes, achieving a natural well groomed look. (FIG. 3)

The traditional method of applying white fingernail polish consists of drawing a curved line at the tip of the nail, with a round or flat bristle brush. This method requires skill and a steady hand in order to achieve a perfect tip. Further difficulty is encountered when using the weaker hand to apply nail polish to one's own hand. The usual result is an uneven or crooked line of varying widths. Another option is to have them done professionally which can be done in a variety of methods including airbrush, acrylic, or by hand, which can become costly.

SUMMARY OF THE INVENTION

In one embodiment of the present invention, a nail polish applicator is provided comprising a central hub and a plurality of differently sized protruding portions spaced apart around the hub, each of the protruding portions presenting an arcuately shaped end portion. Preferably, the applicator comprises four differently sized protruding portions spaced apart around the hub. The applicator hub preferably presents four edges, with one protruding portion extending from each of the edges, respectively. Each of the protruding portions preferably presents a generally concave cross-sectional profile. The applicator is preferably unitarily formed from a pliable, resilient plastic material.

In another embodiment of the present invention, a method for applying nail polish to a human nail is provided comprising the steps of loading nail polish onto an applicator comprising a central hub and a plurality of differently sized protruding portions spaced apart around the hub, each of the protruding portions presenting an arcuately shaped end portion, the nail polish being loaded onto one of the applicator end portions; and contacting the polish loaded applicator end portion with a human nail thereby transferring at least a portion of the polish onto the nail. The contacting step preferably results in the formation of an arcuate polish border on the nail. The arcuate polish border preferably separates a portion of the nail without the polish deposited thereon from a portion of the nail with the polish deposited thereon. The contacting step may include applying a compressive force to the protruding portion including the polish loaded end portion so that the polish loaded end portion conforms to the shape of the nail. It is also preferable to repeat the above-mentioned steps to finish applying polish to the remaining nails. In this manner, nail polish may be loaded onto the same or another end portion of another of the applicator protruding portions and the same or other polish loaded applicator end portion contacted with another human nail thereby transferring at least a portion of the polish onto the other nail.

DETAILED DESCRIPTION OF THE PREFERRED EMBODIMENT

The following description sets forth preferred apparatus and method according to the present invention. It is to be understood, however, that this description is provided by way of illustration and nothing therein should be taken as a limitation upon the overall scope of the invention.

Figure 5:
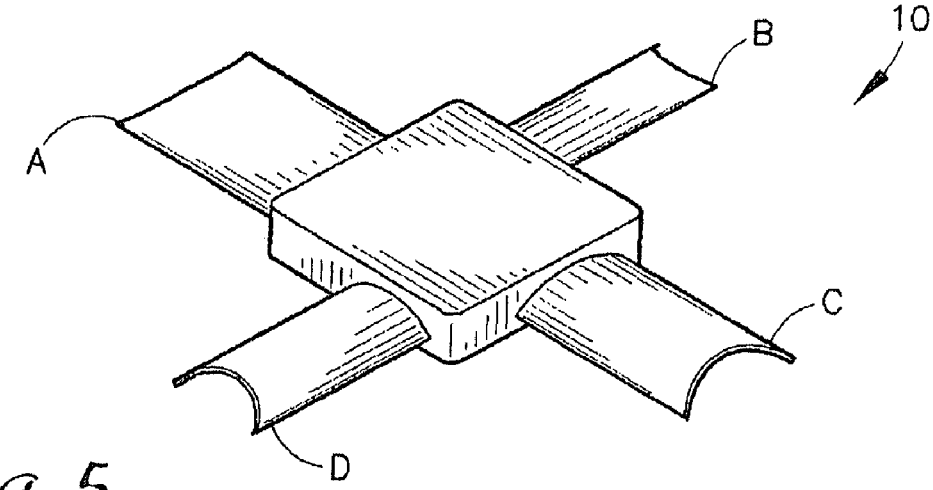
FIG. 5 Is a view of the tool used as described.
Figure 6:
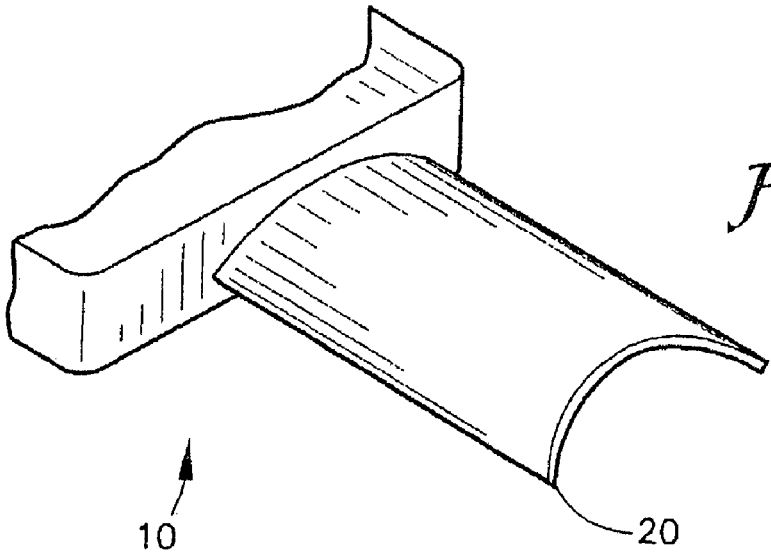
FIG. 6 Is a view of the outermost portion of the tool used for applying polish. (20)

A preferred embodiment of this invention would be described as a central hub (FIG. 5) surrounded by, but not limited to, four different sized, thin flexible protrusions (a, b, c, d). Each protrusion being slightly concave, with inverted crescent shaped ends (20). The preferred material for manufacture would be, but not limited to, a lightweight, flexible material such as plastic or rubber.

Figure 1:
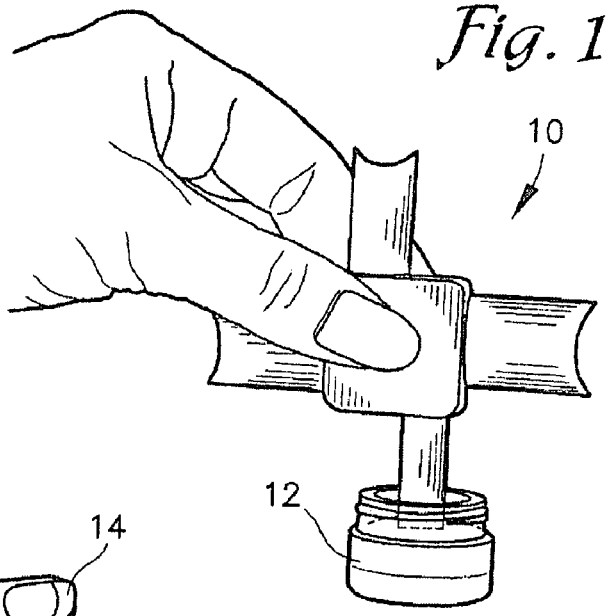
FIG. 1 is a view of the device being dipped into the polish in preparation for applying to nail tip.
Figure 2:
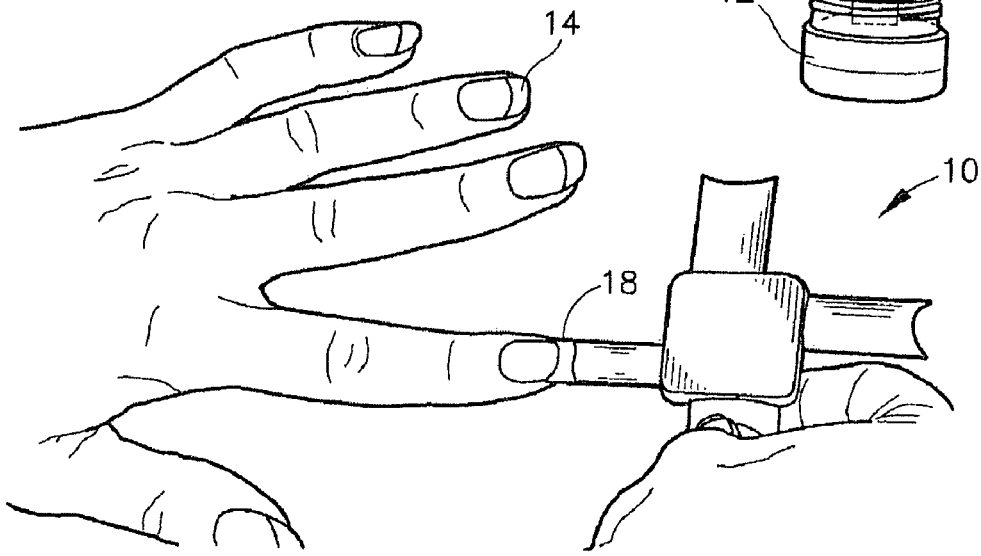
FIG. 2 Is a view of the tool in use as it applies polish to the tip of fingernail (18).

The invention provides a new and unique method of application of the white nail polish (12) to the tips of the nail bed (14). Any end of the described device (10) is dipped into a nail polish (FIG. 1) and then placed parallel onto the tip of the nail bed (18) and quickly removed, leaving an even curved line (14), as illustrated in (FIG. 3) The described method may be employed on both natural and artificial nails.

Figure 3:
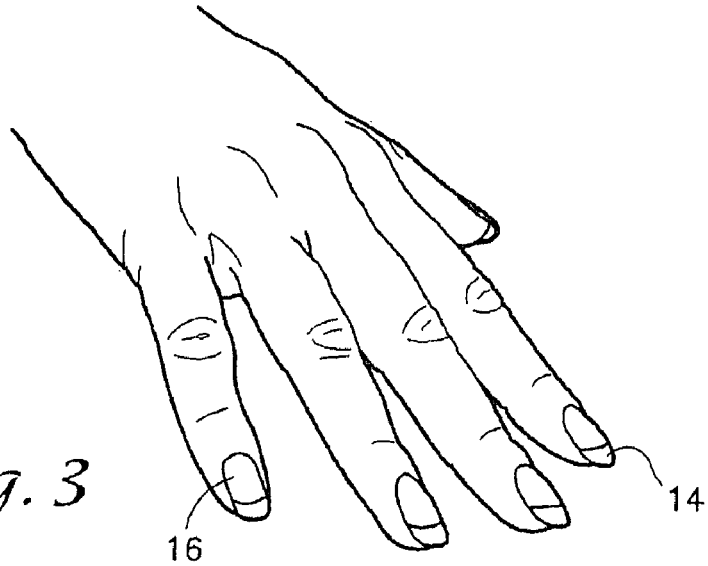
FIG. 3 Is a view of the results you achieve after utilizing tool at tip of fingernail.
Figure 4:
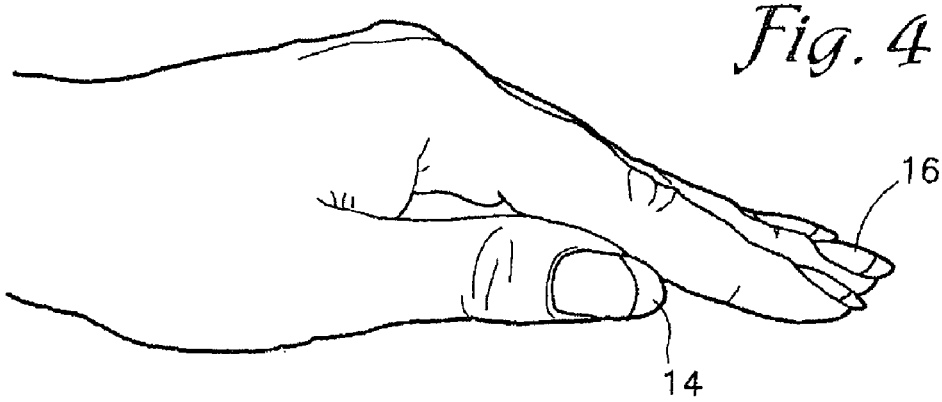
FIG. 4 Is a view of a consistent curved line. (14)

It is an object of the invention to produce a slightly curved even line (14) at the tip of the nail beds as described in (FIG. 4). This method of application is used in the process of what is most popularly known as a French manicure or pedicure. (FIG. 3)

The invention is described as a device with a central hub (10) and four (or any number) different sized, slightly concave protrusions, (a, b, c, d) on which the end of each has inverted crescent shaped ends (a, b, c, d). The tool (10) is made of a thin, light weight flexible material such as plastic or rubber, which can easily be manipulated to fit the curvature of the individual nail by slightly squeezing the ends (20) of the device (10).

An additional advantage of this invention is that each protrusion (a, b, c, d) is a different size than the others so that it can be used for different sizes of fingernails and toenails.

An additional advantage is that the protrusions (a, b, c, d) may be easily trimmed (20) to custom fit the individual user.

I claim:

1. A method of applying polish to a human nail comprising the steps of:

loading nail polish onto an applicator comprising a central hub and a plurality of differently sized protruding portions spaced apart around said hub, said hub including a circumscribing sidewall, each of said protruding portions extending outwardly from said sidewall and having an arcuately shaped end portion each of said protrusion portions having a generally concave cross-sectional profile throughout substantially the entire length thereof, said nail polish being loaded onto one of said applicator end portions; and contacting said polish loaded applicator end portion with a human nail thereby transferring at least a portion of said polish onto said nail.

2. The method of claim 1, said contacting step comprising formation of an arcuate polish border on said nail.

3. The method of claim 2, said arcuately shaped polish border being formed as a part of a French manicure or pedicure.

4. The method of claim 2, said arcuate polish border separating a portion of said nail without said polish deposited thereon from a portion of said nail with said polish deposited thereon.

5. The method of claim 1, said contacting step including applying a compressive force to said protruding portion including said polish loaded end portion so that said polish loaded end portion conforms to the shape of said nail.

6. The method of claim 1, said method further comprising the steps of:

loading nail polish onto the end portion of another of said applicator protruding portions; and contacting said other polish loaded applicator end portion with another human nail thereby transferring at least a portion of said polish onto said other nail.

7. The method of claim 1, said circumscribing sidewall comprising four sidewall segments, and said applicator comprising four protruding portions, said applicator having a respective protruding portion extending outwardly from each sidewall segment.

* * * * *